US005484083A

United States Patent [19]

Joulia

[11] Patent Number: 5,484,083

[45] Date of Patent: Jan. 16, 1996

[54] RECEPTACLE WITH DEFORMABLE FLEXIBLE WALL, OF THE BOTTLE, POUCH OR TUBE TYPE

[75] Inventor: Gerard Joulia, Paris, France

[73] Assignee: L'Oreal, Paris, France

[21] Appl. No.: 374,103

[22] Filed: Jan. 18, 1995

[30] Foreign Application Priority Data

Jan. 18, 1994 [FR] France ..... 94 00466

[51] Int. Cl.[6] ..... B65D 35/08

[52] U.S. Cl. ..... 222/107

[58] Field of Search ..... 222/92, 95, 105, 222/107, 564

[56] References Cited

U.S. PATENT DOCUMENTS

| | | | |
|---|---|---|---|
| 2,792,149 | 5/1957 | Lutz | 222/107 |
| 3,288,334 | 11/1966 | Corsette | 222/107 |
| 3,353,714 | 11/1967 | Trecek | 222/107 |
| 3,508,587 | 4/1970 | Mauch | 222/107 X |
| 4,553,970 | 11/1985 | Lewis, Jr. | 222/107 X |

FOREIGN PATENT DOCUMENTS

| | | | |
|---|---|---|---|
| 960192 | 12/1974 | Canada | 222/95 |
| 0385942 | 7/1991 | European Pat. Off. . | |
| 508168A1 | 10/1992 | European Pat. Off. | 222/107 |
| 2540073 | 8/1984 | France . | |
| 9107292 | 8/1992 | Germany . | |
| 1601424 | 10/1981 | United Kingdom | 222/95 |

*Primary Examiner*—Andres Kashnikow
*Assistant Examiner*—Kenneth Bomberg
*Attorney, Agent, or Firm*—Young & Thompson

[57] ABSTRACT

A receptacle (1) with a deformable flexible wall (2), of the bottle, pouch or tube type, is adapted to contain a liquid or pasty product adapted to be distributed through an outlet opening (3), under the effect of pressure exerted from outside on the flexible wall (2) of the receptacle, leading to the collapse of this wall and a diminution of the internal volume of the receptacle. The receptacle wall has at least one longitudinal strip (4) of a more rigid material and of a peripheral extent (1) sufficient to maintain, within the receptacle, a longitudinal channel adjacent this strip (4), when the regions facing the internal surface of the flexible wall of the receptacle come to bear against each other as a result of the collapse of this wall, progressively with the distribution of the product.

8 Claims, 3 Drawing Sheets

RECEPTACLE WITH DEFORMABLE FLEXIBLE WALL, OF THE BOTTLE, POUCH OR TUBE TYPE

The invention relates to a receptacle with a deformable flexible wall, comprising a one-way dispensing member of the flap, valve or pump type for distribution without taking air back in. This receptacle is of the bottle, pouch or tube type, adapted to contain a liquid or pasty material adapted to be distributed through an outlet opening, under the influence of the action of the one-way dispensing member, effecting the collapse of this wall and a decrease of internal volume of the receptacle.

Such receptacles are used, in particular, for handling cosmetic, pharmaceutical, food products or pastes, such as toothpaste.

Various modes of distribution are possible, according to the manner in which pressure is exerted on the exterior of the flexible wall. A first possibility consists in ensuring the distribution of the product by exerting manual pressure on the flexible wall of the bottle or of the tube. In this case, the receptacle with a flexible wall can be provided, on its outlet opening, with a flexible membrane, of the nipple or flap type, that does not take air back in, permitting the exit of the product and preventing entry of air into the receptacle.

According to another possibility, the flexible wall receptacle is provided on its outlet orifice arranged in the form of a neck, with a pump that doesn't take air back in permitting the distribution of the product. Upon each actuation of the pump, a measured quantity is caused to leave, without taking air back in, such that the receptacle deforms by collapsing progressively as it is emptied.

According to another possibility, such a receptacle with a deformable flexible wall is adapted for an aerosol. The flexible wall receptacle is provided with a valve on its outlet orifice, and the assembly is mounted in a rigid aerosol can which is filled with a propulsion gas exerting a pressure on all the external surface of the flexible wall receptacle. Upon each opening of the valve, a measured quantity of the product contained in the flexible receptacle is dispensed, with deformation and corresponding collapse of the flexible receptacle.

No matter what the mode of dispensing, namely a membrane that does not take back up air, a pump which does not take back up air, aerosol with a pouch, etc., it is desirable to ensure the complete dispensing of the product contained in the flexible receptacle.

However, the collapse of the deformable flexible wall of this receptacle on itself, particularly adjacent the outlet orifice, has a tendency to block the passage of the product of which a substantial part can remain within the deformed flexible receptacle.

So as to prevent or at least to limit this collapse of the flexible wall, leading to retention of an undistributed product within the receptacle, it has been proposed to place within the flexible receptacle a supplemental support element generally called "anti-trapping" provided, for example, in EP-A-0 444 982.

Such an "anti-trapping" element constitutes a supplemental cost of production, with complication of assembly to introduce said element into the flexible receptacle. Moreover, the space occupied by the "anti-trapping" element reduces the available volume for the product within the flexible receptacle.

This invention has for its object above all to provide a receptacle with a deformable flexible wall, comprising a unidirectional dispensing member, of the type defined above, which receptacle permits extracting practically all of the product contained in the receptacle, while avoiding blockage of the outlet due to collapse of the wall, and this without the need for an "anti-trapping" member disposed within the receptacle with a deformable flexible wall.

This object is achieved by a receptacle whose deformable flexible wall comprises means to create longitudinal channels, ensuring an evacuation of the product, having particularly the shape of at least one rigid longitudinal strip.

There is known from EP-A-0 385 942, flexible bottles formed by coextrusion comprising longitudinal rigid strips, separated by flexible regions. These rigid strips are adapted to ensure the stability of the shape of the bottles, and the flexible regions permit the compressibility of the bottle to expel the contained product. These rigid strips, which can constitute the greatest portion of the receptacle, are not adapted for the creation of longitudinal channels preventing the formation of pockets of trapped product, particularly at the end of dispensing of the product. Moreover, this function of the rigid strips is not suggested in this document.

According to the invention, a receptacle with a deformable flexible wall, comprising a one-way dispensing member without taking air back in, adapted to contain a liquid or pasty product adapted to be dispensed through an outlet opening, under the effect of the action of a one-way dispensing member, giving rise to the collapse of the flexible wall and a decrease of internal volume of the receptacle, characterized by the fact that the wall of the receptacle comprises means to create at least one longitudinal channel during the dispensing of the product, preventing retention of the product and therefore ensuring complete dispensing of this product.

By one-way dispensing member, is intended a flap, a pump or a distribution valve.

Preferably, the means to create the longitudinal channel are constituted by at least one longitudinal strip of a more rigid material and of a peripheral extent sufficient to maintain, within the receptacle, this longitudinal channel adjacent the strip, when the confronting regions of the internal surface of the flexible wall of the receptacle come to bear against each other by virtue of the collapse of this wall, progressively with dispensing of the product.

According to the invention, there is provided one or several rigid longitudinal strips according to the shape of the receptacle; in the case of the presence of two rigid longitudinal strips, these are substantially diametrically opposed. For a shape having edges, the strips are preferably located along these edges.

Preferably, the longitudinal strip extends from one end to the other of the receptacle.

Generally, the receptacle has a cylindrical shape, and the longitudinal strip is parallel to the generatrices of the receptacle.

Preferably, the longitudinal strip has a width about 4 mm to 40 mm, according to the periphery of the receptacle. In the case in which the receptacle is cylindrical, its diameter can vary, preferably between 8 and 200 mm. More particularly, the ratio P/1 is comprised between 6 and 16, P being the periphery of the receptacle and 1 being the width of the strip, the values of P and 1 being measured perpendicularly to the axis of dispensing of the receptacle.

In the case in which the transverse cross section of the receptacle is substantially elliptical, preferably a more rigid longitudinal strip is provided at least one of the ends of the major axis of the cross section.

Preferably, the receptacle is made from a tubular blank obtained by extrusion, said blank comprising the mentioned more rigid longitudinal strip or strips obtained by coextrusion.

In the case in which the receptacle is of the robe type, one end of this tubular blank is closed by welding, while the other end is provided with a rigid head provided with an outlet neck.

In the case in which the receptacle is of the bottle type, the tubular blank is subjected to a blowing operation permitting obtaining a bottle with a closed bottom, and provided with a neck at the opposite end from the bottom. The bottle comprises in its bottom a radial sector corresponding to the more rigid strip, this strip extending to the neck and to the shoulder connecting the neck to the body of the bottle.

Thanks to the presence of such rigid longitudinal strips, there is obtained during emptying of the receptacle the creation of dispensing channels oriented in the direction of each strip, accompanied by a crushing or flattening, similarly oriented, of the walls of the receptacle. This oriented crushing or flattening has the advantage of guaranteeing the visibility of the decorations or of the manner of use, which comprise generally receptacles for products adapted to be eaten.

Moreover, according to the teaching of EP-A-0 385 942, there is obtained a mechanical reinforcement of the receptacle, which is desirable, either for industrial mounting of a distribution head and of a mouth on the neck of the receptacle, or for transportation and storage of the receptacle.

Preferably, the material constituting the flexible wall of the receptacle is selected from polyethylene, polyisobutylene, polyethylene vinyl acetate and thermoplastic synthetic rubbers. The material constituting the rigid strips is selected from polypropylene, polycarbonate, polyethylene terephthalate, polyvinyl chloride, polystyrene and polyamide. The pairs of rigid and flexible materials are selected so as to be chemically compatible, which is to say to be able to bond with each other by thermofusion.

The invention also relates to a process for the production of a receptacle with a flexible wall, of the bottle type, pouch type or tube type characterized by the fact that, in a first step, there is provided by coextrusion a tubular blank comprising at least one longitudinal strip of more rigid material extending over a limited angular sector. The process of production of a bottle comprises a second step of blowing in the course of which the blank is transformed into a bottle with a closed bottom and provided with a neck, the more rigid strip extending radially in the bottom of the bottle and extending over the neck.

Preferably, the flexible wall of the receptacle can be of low density polyethylene, while the strip of more rigid material is of high density polyethylene.

The invention consists, in addition to the arrangements described above, of a certain number of other arrangements to be described hereafter relative to embodiments given with reference to the accompanying drawings, but which are in no way limiting.

FIG. 1 of these drawings is a schematic perspective view, from below, of a flexible wall bottle according to the invention.

Figure 1:
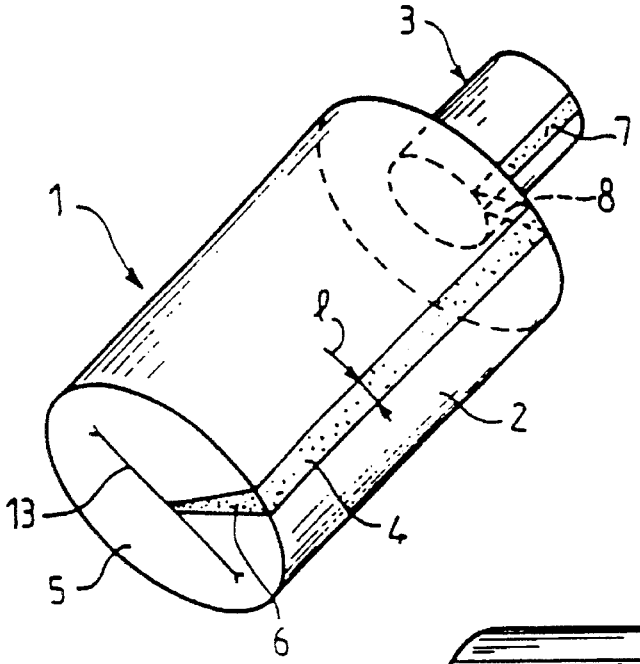

Referring to FIG. 1, there is seen a bottle 1 with a deformable flexible wall 2, of generally cylindrical shape. This bottle 1 is adapted to contain a liquid or pasty product adapted to be dispensed through an outlet opening constituted by a neck 3. The dispensing of the product through the neck 3 is obtained by exerting pressure from outside on the flexible wall 2.

According to a first possibility, the pressure is exerted manually directly on the wall 2. The neck 3 is then provided on its outlet opening, with a flap or nipple, for example as shown in EP-A-0 452 196, permitting the exit of the product, but opposing air being drawn back into the bottle 1. The wall of bottle 1 will therefore progressively collapse as the product leaves.

According to another possibility, the neck 3 can be provided with a pump that will not take air back in, such as that of EP-A-0 444 982. The dispensing of the product is effected by actuating the pump but, again, the flexible wall 2 collapses progressively as the product leaves.

According to another possibility, the flexible bottle containing the product to be handled is disposed in an aerosol can, the neck of the bottle being provided with a dispensing valve. A propelling gas under pressure, contained in the aerosol can, exerts pressure on the external surface of the bottle to effect dispensing of the product when the valve is actuated. An arrangement of this type is shown for example in FR-B-2 233 843.

The wall 2 of the bottle 1 has a longitudinal strip 4 parallel to the generatrices, of a more rigid material than that of the wall 2 and of a peripheral extent 1. The strip 4 is prolonged along the bottom 5 of the receptacle by a radial sector 6. This strip 4 is prolonged at the opposite end to the neck 3 by a portion 7 connected to the strip 4, via a transverse zone 8 located at the shoulder marking the transition between the body of the bottle and the neck 3. According to the invention, the ratio P/1 satisfies the relationship $6 \leqq P/1 \leqq 16$, P being the perimeter of the receptacle and 1 being the width of the strip, the values P and 1 being measured perpendicular to the axis of dispensing of the receptacle. In particular, a cylindrical receptacle having a perimeter of 16 cm, comprises preferably two longitudinal strips 4 of a width of 1 cm.

Figure 5:
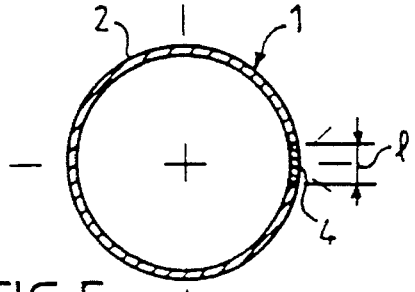
FIG. 5 is a transverse cross section of a tube constituting a receptacle according to the invention, with a circular cross section when undeformed.
Figure 6:
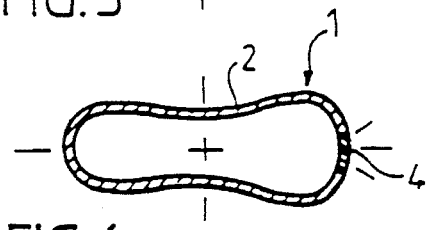
FIGS. 6 and 7 are transverse cross sections of the tube of FIG. 5 as its wall progressively collapses.
Figure 10:
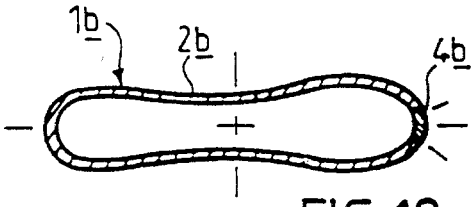

Initially, when the bottle is full of product, its transverse cross section is circular as shown in FIG. 5. At an intermediate stage, the opposed regions of the wall 2 collapse and take an outwardly concave shape as shown in FIG. 6, without coming into contact with each other.

Figure 7:
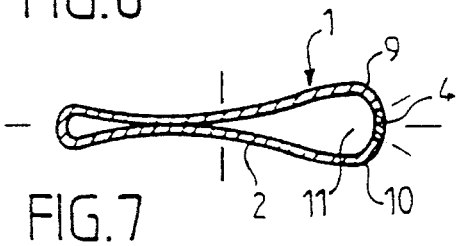
Figure 11:
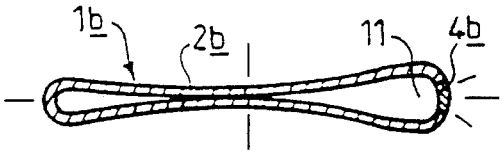

In a final condition of emptying of the bottle 1, the opposite regions of the internal surface of the wall 2 come into contact with each other as shown in FIG. 7. However, the regions 9 and 10 of the flexible wall 2 adjacent the edges of the rigid strip 4 are maintained spaced from each other and maintain an outwardly convex shape such that a passage 11, in the longitudinal direction, remains. Communication is thus maintained, by this passage 11, between the internal region of the bottle 1, adjacent the bottom 5, and that adjacent the neck 3.

Figure 8:
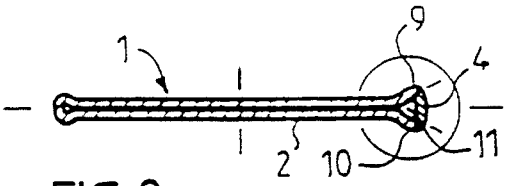
FIG. 8 is a transverse cross section corresponding to maximum collapse of the flexible wall of the tube of FIG. 5, a passage remaining along the more rigid strip.
Figure 12:
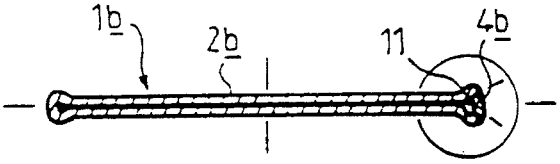

When the opposite surfaces of the wall 2 are completely collapsed, as shown in FIG. 8, the channel 11 remains adjacent the strip 4, with a cross section that is reduced but sufficient to ensure the passage of the remaining product from the bottom 5 toward the neck 3.

Figure 13:
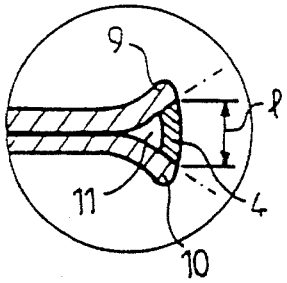
FIG. 13 is an enlarged detail of FIGS. 8 and 12.

FIG. 13 shows on a larger scale the strip 4 and the channel 11 when the walls are totally collapsed.

The peripheral extent 1 of the strip 4 is chosen to be sufficient to maintain within the receptacle 1 a channel 11 adapted to permit the complete dispensing of the product from the bottom toward the outlet.

Figure 3:
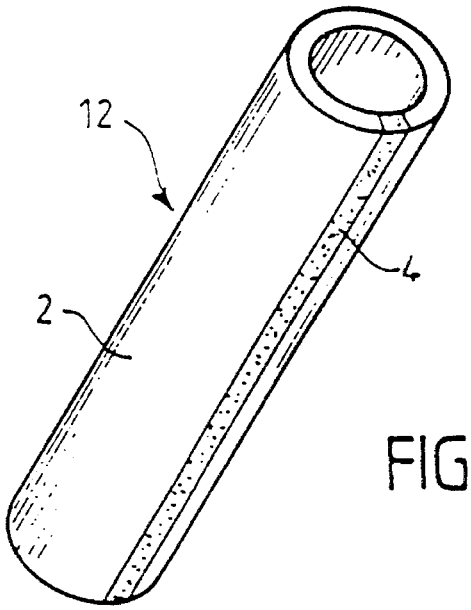
FIG. 3 shows schematically in perspective a tubular blank obtained by coextrusion for the production of a receptacle according to the invention.

The bottle 1 is preferably made from a blank 12 (see FIG. 3) constituted by a cylindrical tubular member comprising the strip 4, this blank 12 being obtained by coextrusion. The wall 2 of the cylindrical tube of flexible material, constituting most of the blank 12, is obtained by extrusion, for example of low density polyethylene. There is associated with this principal portion of flexible material, by coextrusion, a small sector of cylindrical tube, corresponding to the strip 4, of more rigid material, for example high density polyethylene.

The blank 12 is then subjected to a blowing operation in a mold whose shape corresponds to that of the bottle 1 shown in FIG. 1.

The bottom 5 of the bottle is formed by welding along a line 13, of portions of the flexible wall 2 that come into contact in the course of the blowing operation. The weld line 13 is preferably orthogonal to the strip 4 which is extended along the bottom 5 by the sector 6. The portion of the blank located on the side of the weld line 13 opposite the bottom 1 is eliminated by cutting off adjacent the weld line.

The extrusion-blowing process, known per se, will not be described further. Reference could be had for example to GB-A-2 023 088 or FR-A-1 365 964, for more details concerning the blowing operation after extrusion.

The reinforcement sector constituted by the strip 4 of more rigid material can have a shape that varies according to the shape of the bottle or of the pouch obtained by the blowing operation.

Figure 2:
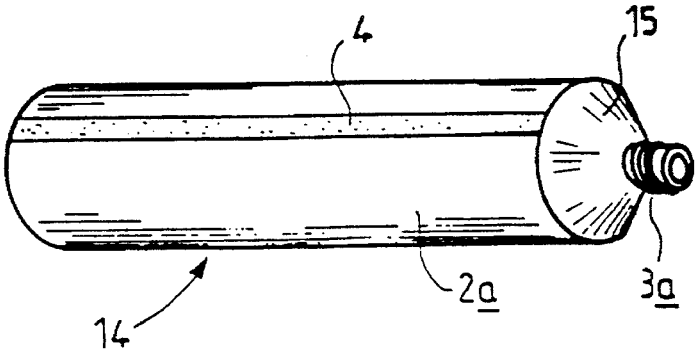
FIG. 2 is a perspective view of a flexible wall tube according to the invention.
Figure 4:
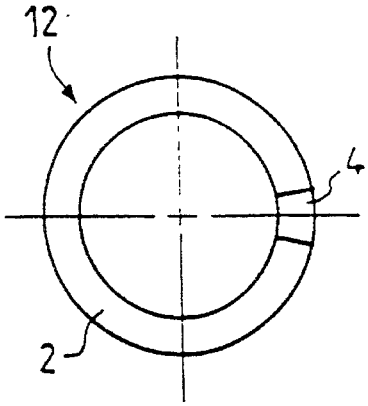
FIG. 4 is a transverse cross section of the blank of FIG. 3.

FIG. 2 shows a tube 14 constituting a receptacle according to the invention comprising a cylindrical body of flexible material provided with at least one longitudinal strip 4 of more rigid material.

The tube 14 is obtained directly from a blank 12 whose end is closed, for example by welding in a direction orthogonal to the strip 4, and whose other end is provided with a rigid head 15 having a neck 3*a*.

The behavior of the cylindrical body 2*a* forming the flexible wall of tube 14 will be the same as that explained with reference to FIGS. 5–8, in the course of dispensing the product.

Figure 9:
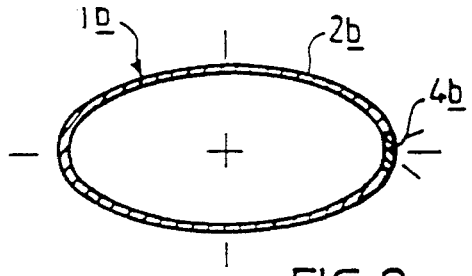
FIGS. 9 to 12 show in a manner similar to FIGS. 5 to 8 the behavior of a tube whose transverse cross section is initially elliptical as shown in FIG. 9.

FIGS. 9 to 12 show, similarly to FIGS. 5 to 8, the behavior of a receptacle 1*b* with a flexible wall, provided with a longitudinal strip 4*b* of more rigid material, with an initially elliptical transverse cross section as shown in FIG. 9. The strip 4*b* is located at one end of the major axis of the ellipse. The successive deformations of the flexible wall 2*b*, as dispensing of the product progresses, are similar to those illustrated in FIGS. 6 to 8. The more rigid strip 4*b* maintains within the receptacle a channel 11 adjacent to the strip 4*b*.

Of course, similar longitudinal strips such as 4 could be provided, regularly spaced about the periphery of the flexible receptacle.

Figure 14:
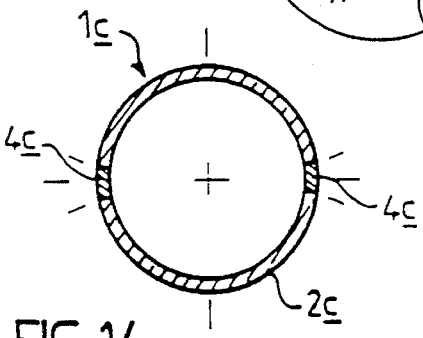
FIG. 14 is a transverse cross section of a tube comprising two diametrically opposed longitudinal strips of more rigid material.

FIG. 14 shows an embodiment of receptacle 1*c* with an initially circular cross section comprising two strips of more rigid material 4*c*, diametrically opposed.

Figure 15:
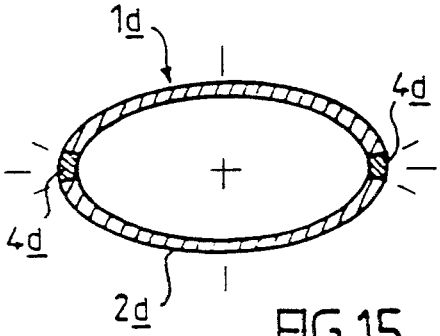
FIG. 15 is a transverse cross section of a tube of elliptical cross section also comprising two longitudinal diametrically opposed more rigid strips.

FIG. 15 shows a flexible receptacle 1*d* analogous to the initial transverse cross section of elliptical shape, in which the two more rigid bands 4*d* are provided at the ends of the major axis of the transverse cross section.

Figure 16:
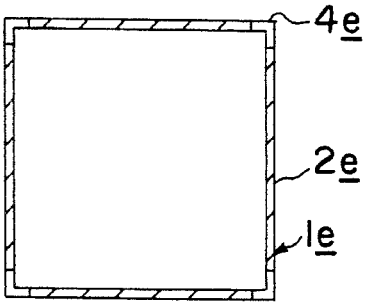
FIGS. 16 to 19 show, in a manner similar to FIGS. 9 to 12, the arrangement of a tube whose transverse cross section initially is square as shown in FIG. 16.
Figure 17:
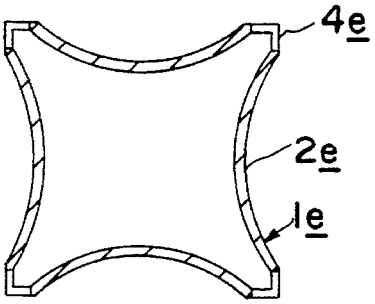
Figure 18:
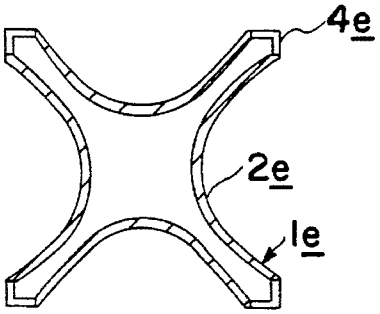
Figure 19:
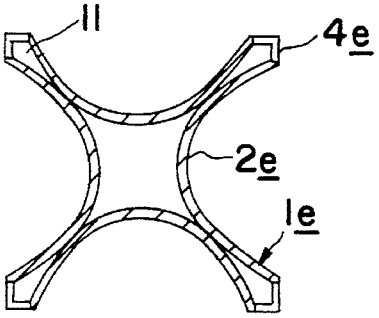

FIGS. 16 to 19 show, similarly to FIGS. 9 to 12, the behavior of a receptacle 1*e* with a flexible wall 2*e*, provided with several longitudinal strips 4*e* of more rigid material, with an initially square cross section as shown in FIG. 16. The strips 4*e* are located in the corners of the square. The successive deformations of the flexible wall 2*e*, as dispensing of the product progresses, are similar to those shown in FIGS. 5 to 8. The more rigid strips 4*e* maintain within the receptacle a channel 11 adjacent each strip 4*e*.

Figure 20:
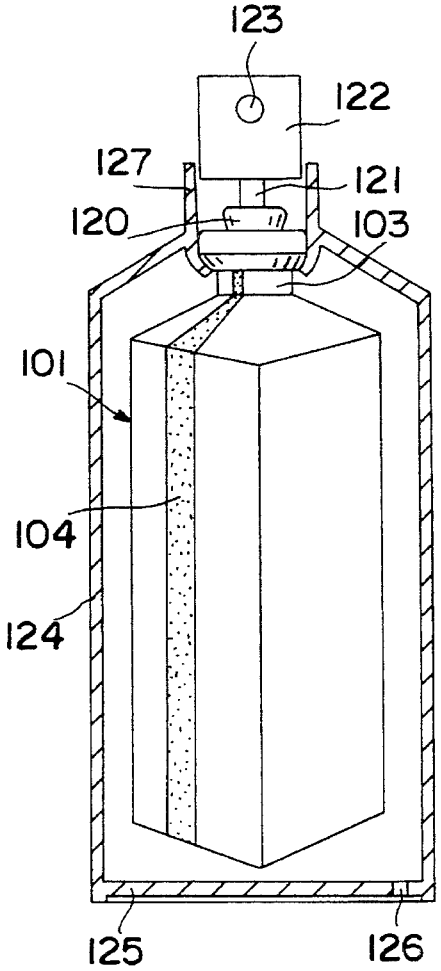
FIG. 20 is a transverse cross section of a dispenser with a pump provided with a pouch of square cross section comprising two longitudinal diametrically opposed more rigid strips.

FIG. 20 shows a dispenser provided with a flexible pouch 101 of square cross section comprising two diametrically opposed more rigid longitudinal strips 104. The pouch 101 comprises a neck 103, in which is inserted the body of a pump 120 that does not take air back in. It is disposed within a rigid chamber 124 provided with a bottom 125 and a neck 127. The pump 103 is fixed in the neck 127 of the chamber 124. In the bottom 125 is located a vent opening 126 serving to balance the internal pressure of the chamber 124 as dispensing of the product contained in the pouch 101 proceeds. The pump 120 comprises a control rod 121 connected to a pushbutton 122 provided with a dispensing nozzle 123.

During dispensing of the product by actuation of the pump 120, the pouch 101 flattens, forming at the end of emptying two longitudinal dispensing channels adjacent the strips 104, permitting the complete dispensing of the product, and therefore preventing retention of the product. The chamber 124 is utilized only for aesthetic reasons. It could of course be omitted.

In a flexible receptacle produced according to the invention, the deformation of the flexible wall, during progressive dispensing of the product, is "oriented" because of the presence of the strip or strips of more rigid material such as 4. It is thus possible to position the decoration or the principal surface of the receptacle with regard to the rigid sector constituted by the strip or strips such as 4. The industrial production by extrusion/blowing of the flexible receptacle according to the invention can be carried out at a competitive cost.

The receptacle of the invention can be made according to conventional techniques of two-material coextrusion. Moreover, the bottle can be opaque with one or several transparent strips permitting displaying the level of the product.

The flexible receptacle with a deformable wall according to the invention permits maintaining a dispensing passage adjacent the internal surface of the strip of more rigid material, which guarantees the total dispensing of the product. Such a receptacle is particularly interesting for numerous cosmetic, pharmaceutical or food uses, and for other industrial fields (glue).

I claim:

1. In an elongated receptacle (1, 101) with a deformable flexible wall (2, 102), comprising a one-way dispensing member that does not take air back in, adapted to contain a flowable product to be distributed through an outlet opening, under the influence of the one-way dispensing member, causing the collapse of the flexible wall and a decrease of internal volume of the receptacle, the wall (2, 102) of the receptacle comprising means (4, 104) to create at least one longitudinal channel (11) upon dispensing of the product, preventing a retention of the product and therefore ensuring the complete dispensing of this product, said means comprising at least one strip extending lengthwise of the receptacle and comprising an integral portion of a side wall of the receptacle; the improvement wherein said at least one strip is of a material different from and more rigid than the material of the remainder of said side wall of the receptacle.

2. An elongated receptacle as claimed in claim 1, wherein said at least one strip is of the same thickness as said material of the remainder of the side wall.

3. An elongated receptacle according to claim 1, wherein said flexible wall of the receptacle is of low density polyethylene, whilst said at least one strip is of high density polyethylene.

4. In an elongated receptacle (1, 101) with a deformable flexible wall (2, 102), comprising a one-way dispensing member that does not take air back in, adapted to contain a flowable product to be distributed through an outlet opening, under the influence of the one-way dispensing member, causing the collapse of the flexible wall and a decrease of internal volume of the receptacle, the wall (2, 102) of the receptacle comprising means (4, 104) to create at least one longitudinal channel (11) upon dispensing of the product, preventing a retention of the product and therefore ensuring the complete dispensing of this product, said means comprising at least one strip extending lengthwise of the receptacle and comprising an integral portion of a side wall of the receptacle; the improvement wherein said receptacle also has a bottom wall and said at least one strip extends across at least a portion of said bottom wall.

5. An elongated receptacle as claimed in claim 4, wherein said elongated receptacle also has an upper wall and a neck, and said at least one strip extends across at least a portion of said upper wall and along all the length of said neck.

6. An elongated receptacle according to claim 4, wherein said flexible wall of the receptacle is of low density polyethylene, whilst said at least one strip is of high density polyethylene.

7. In an elongated receptacle (1, 101) with a deformable flexible wall (2, 102), comprising a one-way dispensing member that does not take air back in, adapted to contain a flowable product to be distributed through an outlet opening, under the influence of the one-way dispensing member, causing the collapse of the flexible wall and a decrease of internal volume of the receptacle, the wall (2, 102) of the receptacle comprising means (4, 104) to create at least one longitudinal channel (11) upon dispensing of the product, preventing a retention of the product and therefore ensuring the complete dispensing of this product, said means comprising at least one strip extending lengthwise of the receptacle and comprising an integral portion of a side wall of the receptacle; the improvement wherein said elongated receptacle also has an upper wall and a neck, and said at least one strip extends across at least a portion of said upper wall and along all the length of said neck.

8. An elongated receptacle according to claim 7, wherein said flexible wall of the receptacle is of low density polyethylene, whilst said at least one strip is of high density polyethylene.

* * * * *